US008833272B2

(12) United States Patent
Hendershot et al.

(10) Patent No.: US 8,833,272 B2
(45) Date of Patent: Sep. 16, 2014

(54) COMPOSITE TABLE

(71) Applicant: Ditto Sales, Inc., Jasper, IN (US)

(72) Inventors: Ross Hendershot, Grandview, IN (US); Mark Dilger, Ferdinand, IN (US); Timothy Hedinger, Bristow, IN (US); Jeff Jahn, Ferdinand, IN (US); Burgess Heberer, Jasper, IN (US); Jeremiah Thompson, Winslow, IN (US); Shlomo Haviv, Ottawa, OH (US)

(73) Assignee: Ditto Sales, Inc., Jasper, IN (US)

( * ) Notice: Subject to any disclaimer, the term of this patent is extended or adjusted under 35 U.S.C. 154(b) by 10 days.

(21) Appl. No.: 13/897,803

(22) Filed: May 20, 2013

(65) Prior Publication Data

US 2013/0305966 A1 Nov. 21, 2013

Related U.S. Application Data

(60) Provisional application No. 61/648,800, filed on May 18, 2012.

(51) Int. Cl.

| | |
|---|---|
| ***A47B 3/00*** | (2006.01) |
| ***A47B 3/08*** | (2006.01) |
| ***A47B 13/08*** | (2006.01) |
| *A47B 21/06* | (2006.01) |

(52) U.S. Cl.

CPC ... *A47B 3/00* (2013.01); *A47B 3/08* (2013.01); *A47B 13/08* (2013.01); *A47B 21/06* (2013.01); *A47B 2200/0036* (2013.01)

USPC ..... 108/115; 108/6

(58) Field of Classification Search

CPC ..... A47B 3/00; A47B 7/02; A47B 13/003

USPC ..... 108/6, 9, 115, 124

See application file for complete search history.

(56) References Cited

U.S. PATENT DOCUMENTS

| | | | | |
|---|---|---|---|---|
| 4,248,161 | A * | 2/1981 | Adair et al. | 108/6 |
| 6,748,876 | B2 * | 6/2004 | Preisler et al. | 108/57.25 |
| 6,837,171 | B1 * | 1/2005 | Clark et al. | 108/131 |
| 7,171,910 | B2 * | 2/2007 | Neunzert et al. | 108/132 |
| 7,836,833 | B2 * | 11/2010 | Kumazawa | 108/115 |
| 7,878,128 | B2 * | 2/2011 | Watson et al. | 108/132 |
| 8,091,488 | B2 * | 1/2012 | Chirea et al. | 108/115 |
| 8,291,830 | B2 * | 10/2012 | Rutz | 108/7 |
| 2007/0261611 | A1 * | 11/2007 | Kumazawa | 108/115 |
| 2008/0295742 | A1 * | 12/2008 | Henriott | 108/6 |
| 2010/0186640 | A1 * | 7/2010 | Leng | 108/119 |
| 2011/0017107 | A1 * | 1/2011 | Ko | 108/64 |
| 2013/0284076 | A1 * | 10/2013 | Okuda et al. | 108/115 |

* cited by examiner

*Primary Examiner* — Daniel Rohrhoff

(74) *Attorney, Agent, or Firm* — Maginot, Moore & Beck, LLP

(57) ABSTRACT

A table is provided that comprises a composite table top including a honeycomb core and a laminate layer on a top surface of said core and a plurality of ribs arranged substantially parallel to each other along a length of the core, the ribs including a top plate affixed to the core, a bottom beam opposite the top plate, and a web structure connecting the top plate to the bottom beam. The web structure defines a plurality of openings therethrough. The table further includes a leg assembly including a center beam extending parallel to the length dimension of the core perpendicular to the plurality of ribs, with support legs engaged to the opposite ends of the center beam and configured to support the table top. The table is provided with at least two pivot mechanisms, each pivot mechanism connected between the center beam and the composite table top.

14 Claims, 16 Drawing Sheets

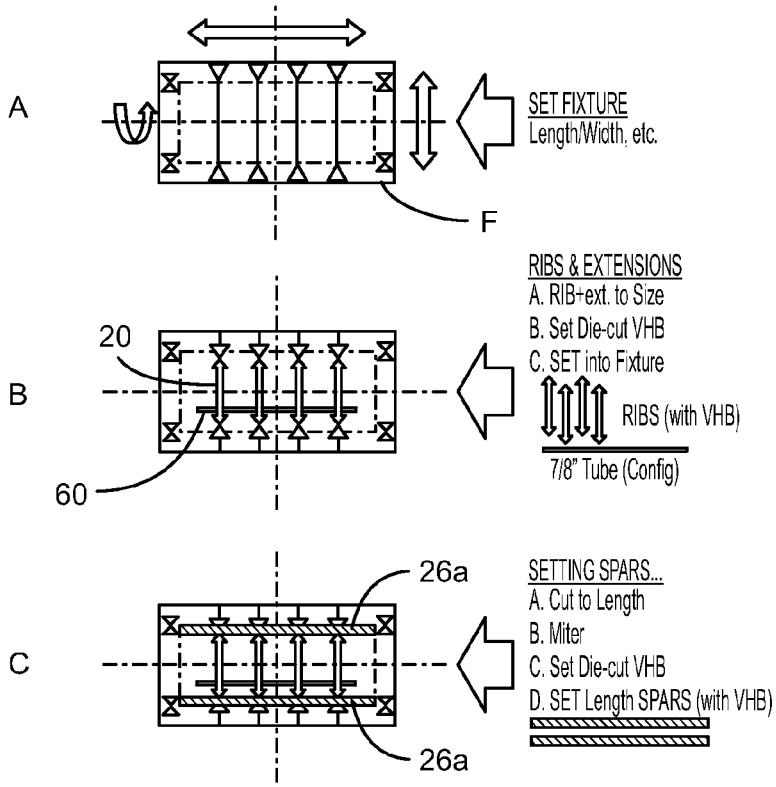
FIG. 13A
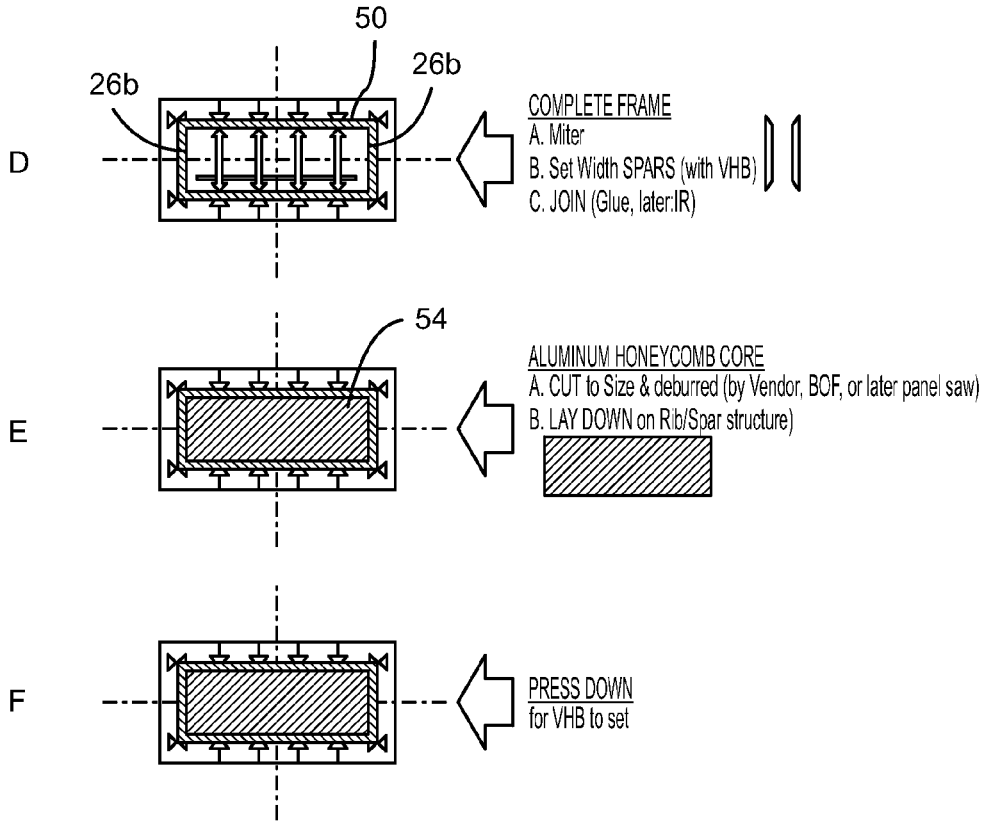

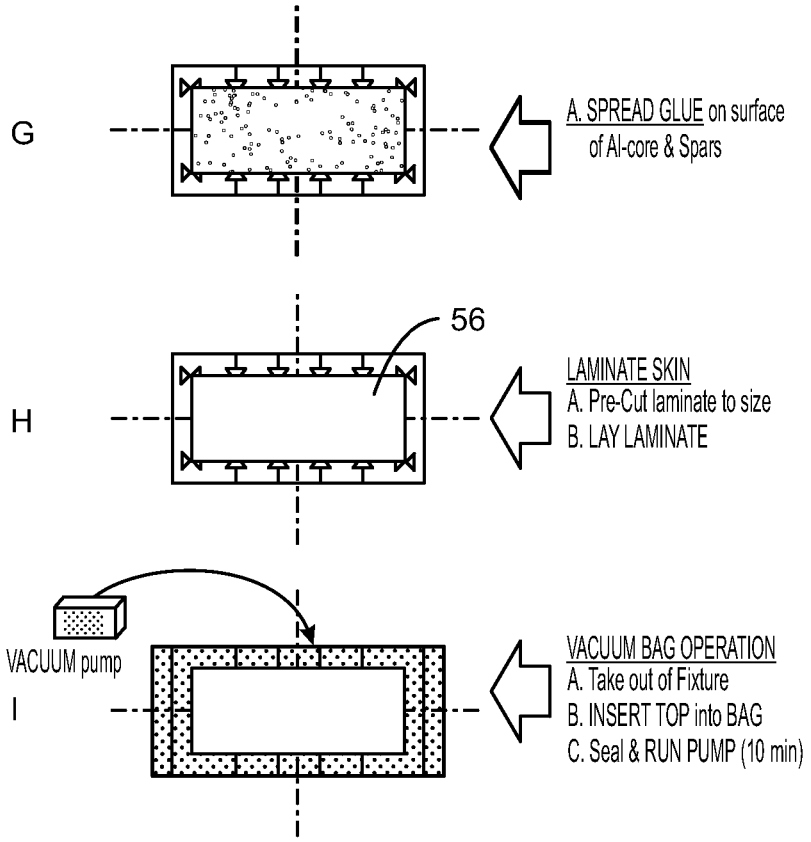
FIG. 13B
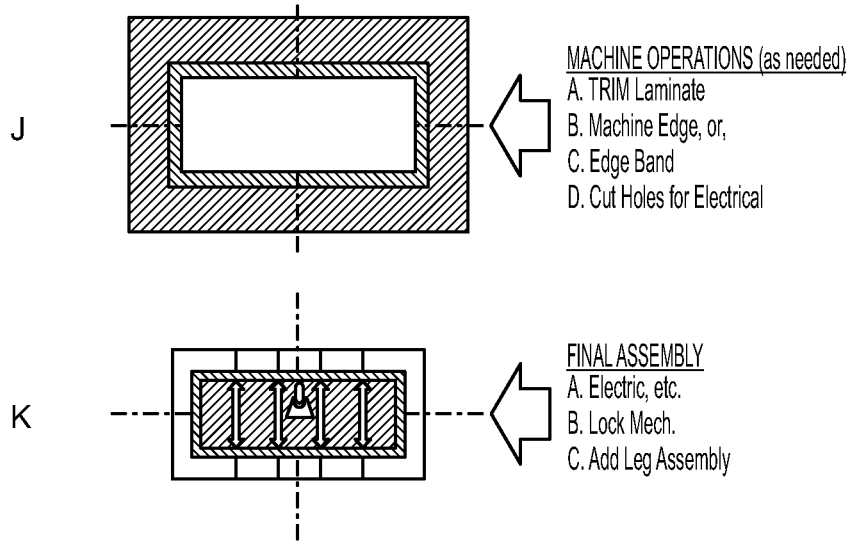

COMPOSITE TABLE

The present application claims priority to and is a utility application filing from provisional application No. 61/648,800, filed on May 18, 2012, the entire disclosure of which is incorporated herein by reference.

BACKGROUND

The present disclosure relates to tables, such as office, conference and training tables. In particular, the disclosure relates to the construction of a multi-functional composite table top.

Many conference, office and training tables are configured to be moved to a folded configuration for storage. In this configuration the table top is typically pivoted from the horizontal in-use position to a vertical or near-vertical orientation. This stowed configuration allows the table to be tightly nested with other tables so that multiple tables can be stored in the envelope that would otherwise be occupied by a single table.

Traditional folding tables employ a heavy, typically hardwood, table top that is necessary so that the table top can endure the wear and tear of normal use. While the heavy table top provides a stable and durable work surface, the weight of the table top makes it very cumbersome to pivot to the near-vertical stowed position. Moreover, the heavy weight makes the table, whether folded or extended, difficult to transport to and from storage.

Providing a lightweight table top can be readily achieved by using different materials, but the result is that the table top is unable to withstand even normal use. Moreover, most lightweight materials lack the necessary stiffness to provide a rigid planar work surface.

Consequently, there is a need for a conference, office or training table that is both light weight and durable.

SUMMARY OF THE DISCLOSURE

A table is provided that comprises a composite table top including a honeycomb core and a laminate layer on a top surface of the core and a plurality of ribs arranged substantially parallel to each other along a length of the core, the ribs including a top plate affixed to the core, a bottom beam opposite the top plate, and a web structure connecting the top plate to the bottom beam. The web structure defines a plurality of openings therethrough. The table further includes a leg assembly including a center beam extending parallel to the length dimension of the core perpendicular to the plurality of ribs, with support legs engaged to the opposite ends of the center beam and configured to support the table top. The table is provided with at least two pivot mechanisms, each pivot mechanism connected between the center beam and the composite table top. In one aspect, each of the at least two pivot mechanisms is connected to the table top through at least two of the number of openings of a corresponding one of the plurality of ribs.

In a further feature, the table further comprises a locking mechanism connected between the center beam of the leg assembly and the table top, the locking mechanism configured to lock the table top in a horizontal deployed position and a generally vertical stowed position. The table may include a center rib disposed in the center of the table top and the locking mechanism may includes a pivot link fastened at one end to the center beam and pivotably engaged at an opposite end to one of the plurality of openings in the web structure of the center rib, a latch mechanism mounted to the web structure at another one of the plurality of openings and an engagement bar pivotably mounted at one end to the center beam and configured at an opposite end to engage the latch mechanism when the table top is pivoted upward relative to the center beam. In one aspect, the pivot link, the latch mechanism and the engagement bar straddle the center rib

DESCRIPTION OF THE FIGURES

FIGS. 13A-B are sequential views of process steps in the fabrication of the tabletop shown in FIGS. 11-12.

DETAILED DESCRIPTION

Figure 1:
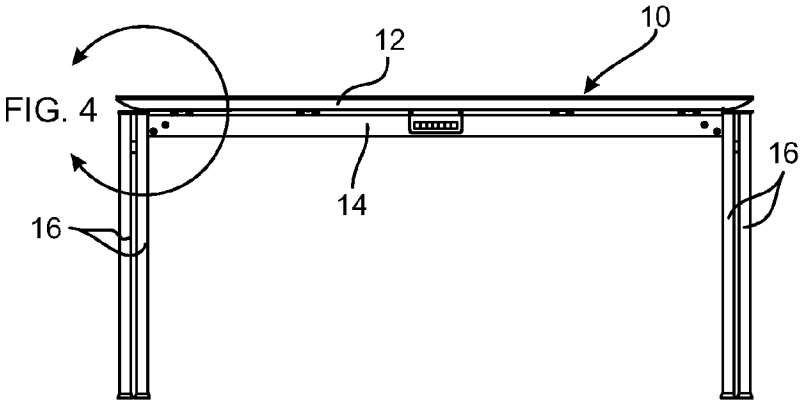
FIG. 1 is a side view of a table according to one embodiment disclosed herein.
Figure 2:
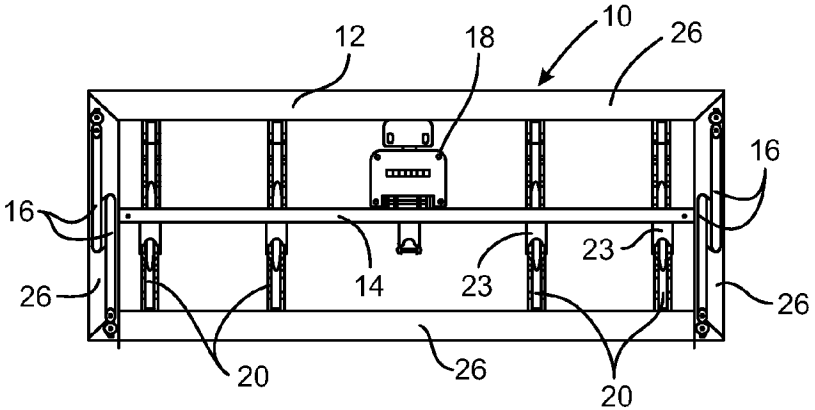
FIG. 2 is a bottom view of the table shown in FIG. 1.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

Figure 3:
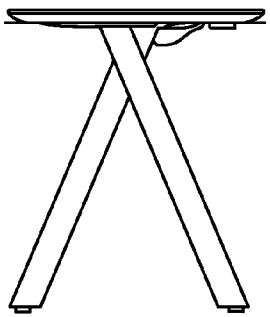
FIG. 3 is a side view of the table shown in FIG. 1.
Figure 4:
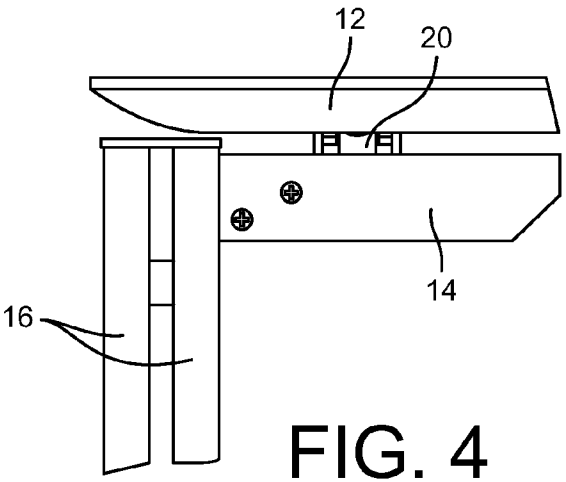
FIG. 4 is an enlarged view of a portion of the table shown in FIG. 1.
Figure 6:
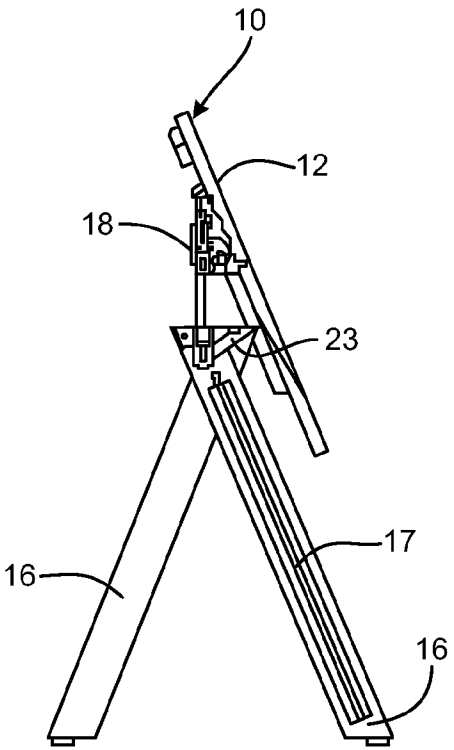
FIG. 6 is a side view of the table shown in FIG. 5.
Figure 5:
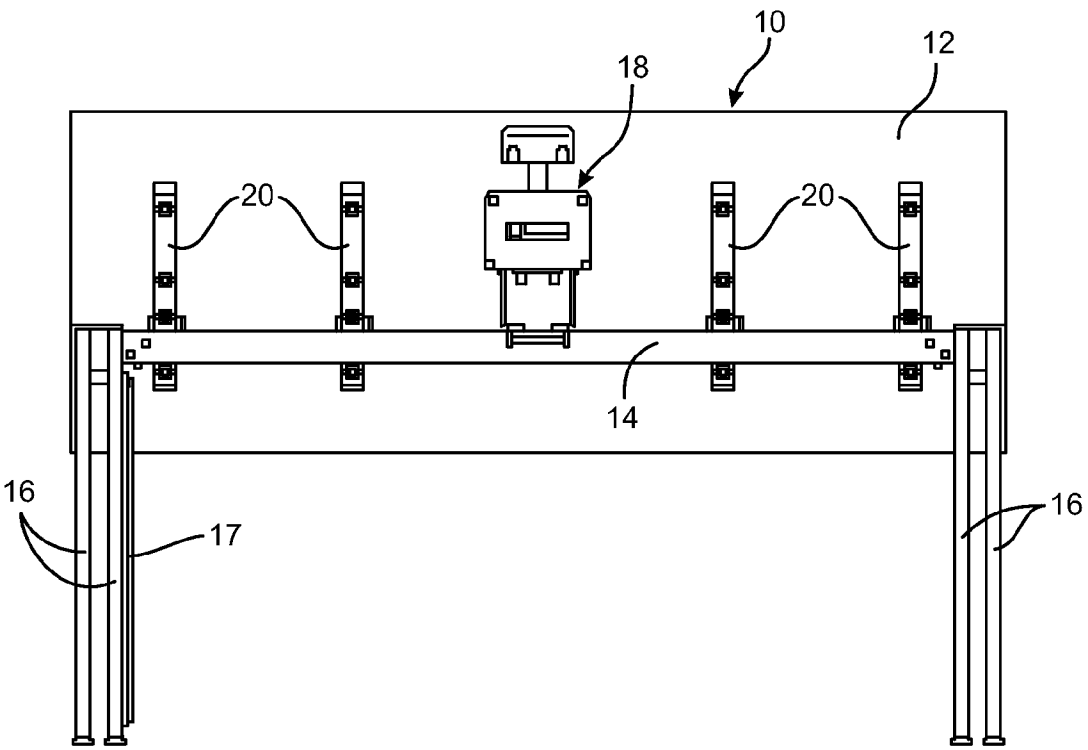
FIG. 5 is a side view of the table of FIG. 1, depicted in its stowed position.

A table 10 according to the present disclosure is shown in FIGS. 1-6. The table includes a table top 12, a center beam 14 and a set of legs 16 mounted to the beam to support the table top. As shown in the bottom view of FIG. 2, the table top 12 includes a number of ribs 20 spanning one dimension (in this embodiment the width) of the table, and a locking mechanism 18 configured to lock the table top in either a deployed position, as depicted in FIGS. 1 and 3, or a stowed position, as shown in FIGS. 5-6. It can be appreciated that in the deployed position the table top 12 is horizontally oriented, while in the stowed position the table top is in a vertical or near-vertical position. For stability, it is preferable that the table top be oriented at an angle of 60-70° relative to the horizontal. It can thus be appreciated that the table top 12 is pivotably mounted to the center beam 14, such as by pivot links 23 best seen in FIGS. 2 and 6. In some cases the table 10 may be provided with electrical connections (such as power and data lines), in which cases one or more of the legs 16 may be provided with a wire management feature 17 configured to cover and protect wires running along the length of the leg.

Figure 7B:
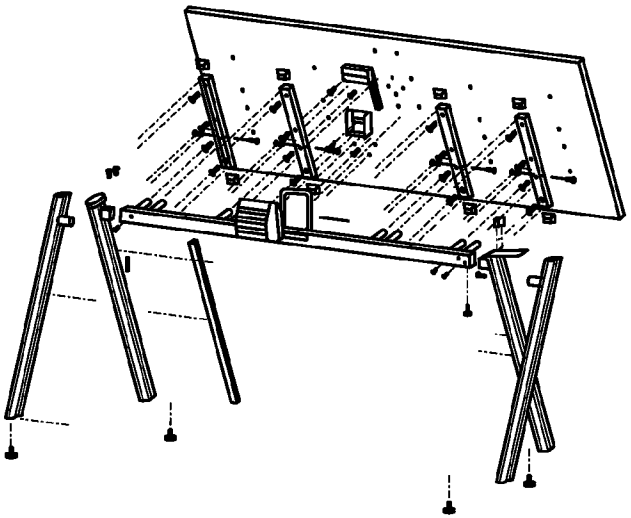
FIGS. 7*a*-7*b* are exploded views of the table shown in FIG. 1.
Figure 7A:
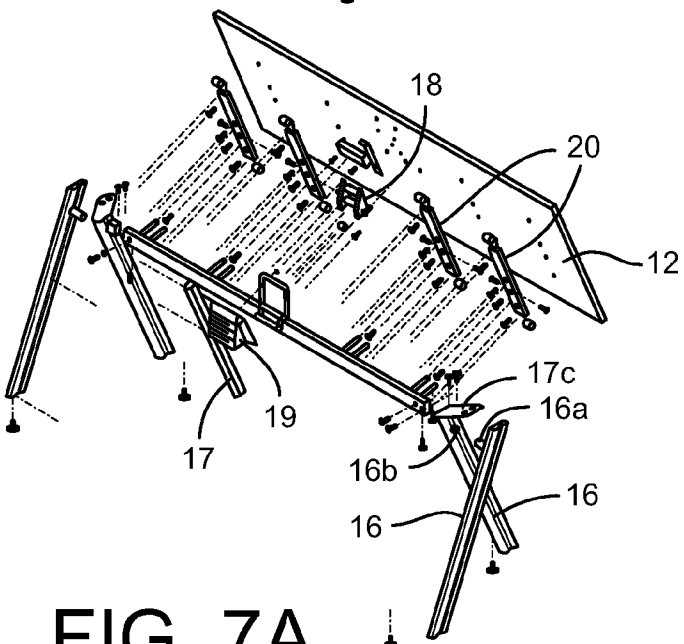

One specific embodiment of the table 10 is shown in the exploded views of FIGS. 7*a*-7*b*. In particular, the ribs 20 may be engaged to the table top 12 by a plurality of fasteners, such as screws. In the leg construction, one of the legs 16 may be provided with a mounting post 16*a* passing through a bore 16*b* in the other leg and a similar bore (not shown) in each end of the center beam 14. A locking plate 17*c* is fastened to the top ends of the legs and to the center beam to fasten the legs to the beam. As seen in FIG. 7*a*, the locking mechanism 18 includes components on the center beam and the table top, with the components protected by a cover 17.

Figure 8:
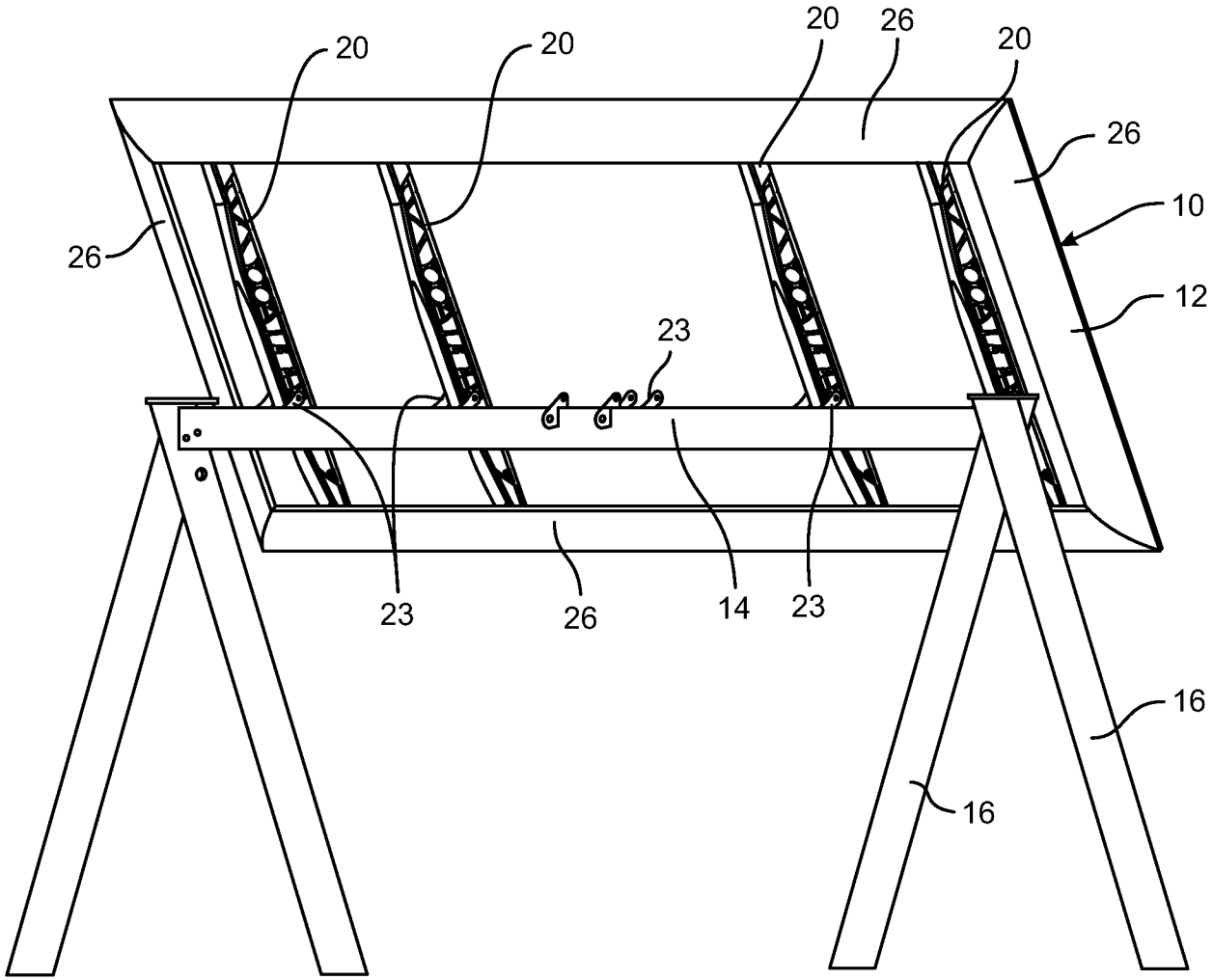
FIG. 8 is a back view of the table shown in the stowed position as in FIG. 5.

Another specific embodiment of the table 10 is shown in FIG. 8. The ribs 20 are more clearly depicted in this figure, as well as the pivot links 23 connecting the table top 12 to the center beam 14. In addition, the table top construction may include spars 26 spanning the perimeter of the table top. Further details of the composite table top construction are explained herein.

Figure 9A:
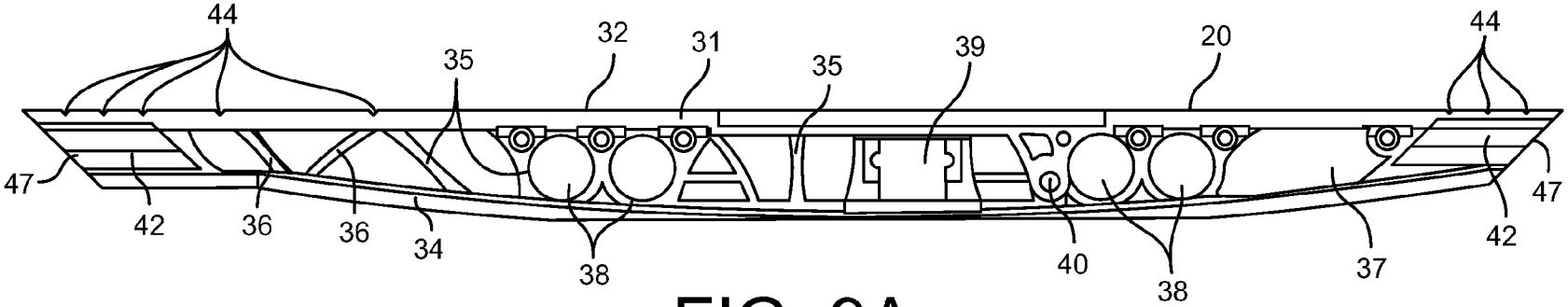
FIGS. 9A-9B are side and top views of a transverse support rib of the table shown in the previous figures.
Figure 9B:
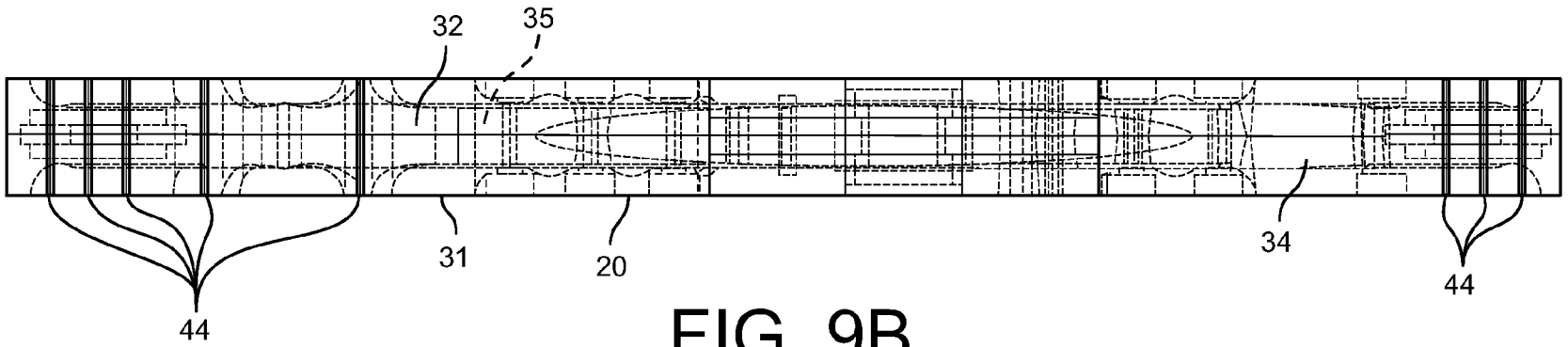

Details of one embodiment of the ribs 20 are shown in FIGS. 9A-9B. In particular, the ribs may be formed of a composite material capable of withstanding the cantilever loads of a typical table. The ribs 20 include a top plate 31 having a top surface 32 and a bottom beam 34, spanned by a vertical web 35. The web is configured to define a number of stiffening ribs 36, pre-defined openings 37 and 39, a number of mounting arrays 38 and a pivot mount opening 40. The web 35 has a thickness and the interior features, particularly the stiffening ribs 36, have a width sufficient to avoid bending or fracture of the rib 20 during normal use of the table. The various interior features defined in the web 25 can serve several functions. For instance, the mounting arrays 38 may be used to attach accessories to the table, such as a keyboard, paper tray or computer mount. The mounting arrays may also be used to support a modesty panel at one side of the table. The opening 37 may be configured to receive a wire management channel. The pivot mount opening 40 is a fastening point for the pivot links 23. It can be appreciated that the web construction of the ribs 20 can significantly reduce the weight of the table structure without sacrificing strength and rigidity.

The ribs 20 can include beveled ends 47 that are configured to engage the spars 26, as described further herein. The ends include cavities 42 that are configured to receive extension elements (not shown) to extend the length of the rib 20. It can be appreciated that the extension elements can have a cross-section similar to that of the ribs 20 with a post configured to fit within the cavity 42 to be held in place by epoxy or other suitable manner. The extension elements thus at least includes a top plate defining a top surface co-extensive with the top surface 31 of the rib when the extension is engaged to the rib. The ribs 20 may thus be configured to be used on tables having a width (or length) greater than the standard 60 inch width.

In addition, the top surface 32 is provided with a series of score lines 44 at each end. The score lines are arranged at pre-determined lengths corresponding to other standard shorter table dimensions. The score lines 44 thus serve as a line for a machine cut to be made at the ends of the rib. The cut made at a particular score line may be angled if the finished end is intended to mate with the spars 26.

Figure 10A:
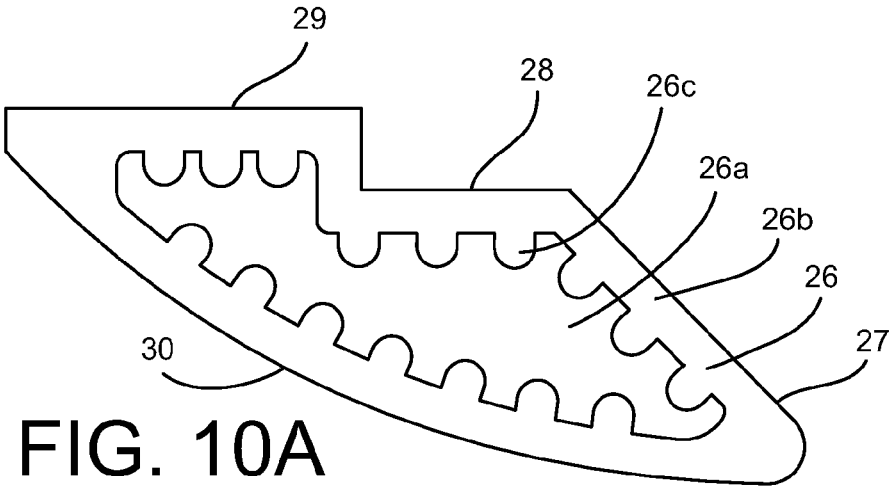
FIGS. 10A-C are cross-sectional views of extruded spars of the table shown in the previous figures.
Figure 10B:
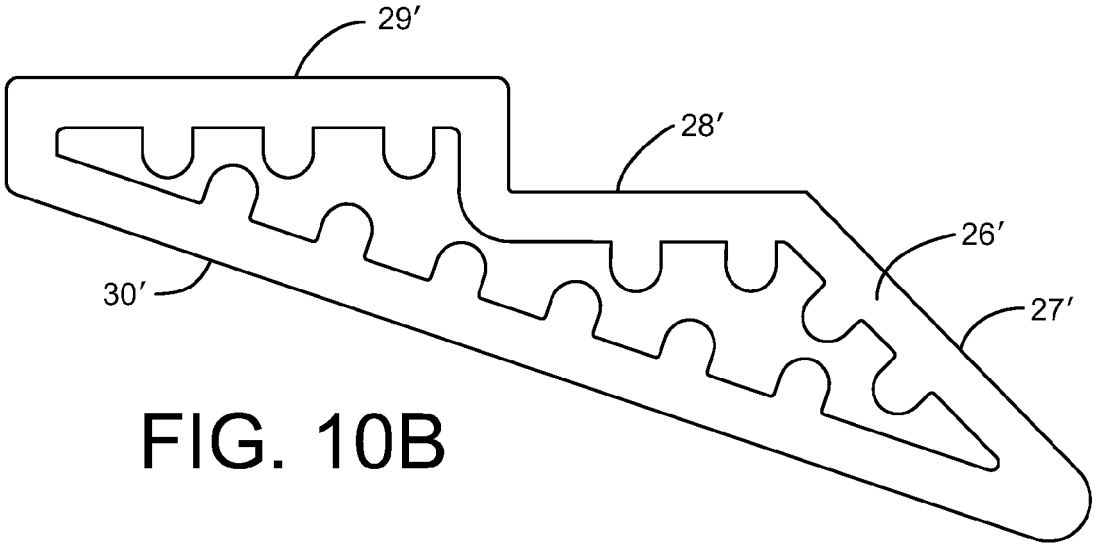
Figure 10C:
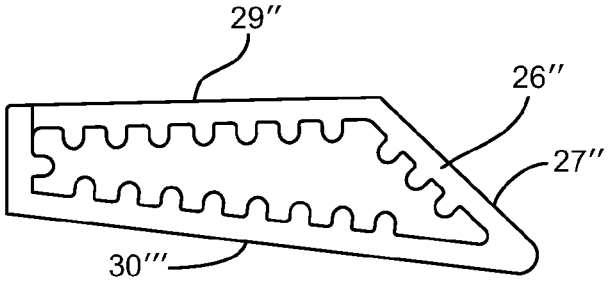
Figure 11B:
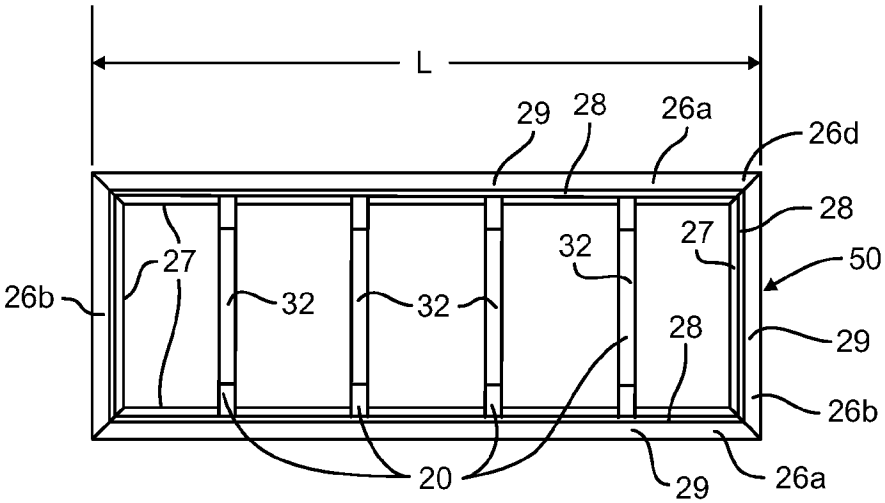
FIGS. 11A-D are views of a tabletop frame for the table shown in the previous figures.
Figure 11D:
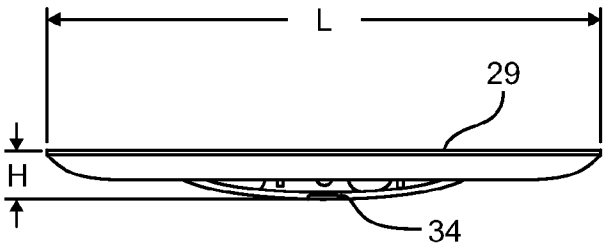
Figure 11A:
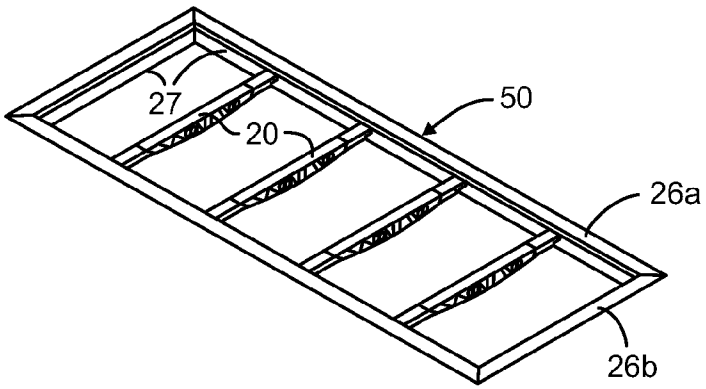
Figure 11C:
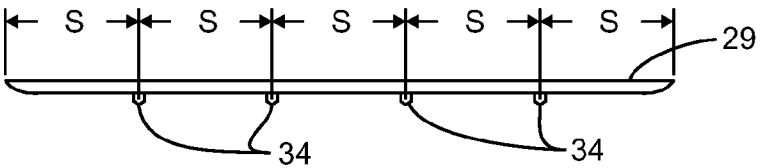

As shown in FIGS. 2, 8 and 11A-B, the spars 26 are sized to fit around the perimeter of the table top 12. In one embodiment, the spars are elongated extrusions, such as the extrusions shown in FIGS. 10A-C. The extrusions are preferably hollow, such as the hollow interior 26*a* formed by the outer wall 26*b* of the extrusion. The outer wall 26*b* may incorporate stiffening ribs 26*c* within the interior 26*a*, as shown in the figures. Each of the spars 26, 26' and 26" of FIGS. 10A-C include a corresponding angled face 27, 27', 27" that is configured for flush contact with the angled end 47 of the ribs 20. Thus, as shown in FIGS. 11A-B a table top frame assembly 50 may be formed by fixing the spars 26 to the ribs 20 at the respective beveled surfaces 27, 47. In one frame construct 50, the ribs 20 are uniformly spaced at a distance S along the length L of opposite spars 26*a* between the spars 26*b* forming the end of the frame. The extruded spars may include mitered ends, such as ends 26*d* in FIG. 11B, to mate when the spars 26*a*, 26*b* are combined to form the table frame 50.

Returning to FIG. 10A, the spar 26 includes a notch 28 and a top surface 29. The notch is configured to receive a table core, as described in more detail herein, with the depth of the notch corresponding to the thickness of the core so that the top surface of the core is contiguous with the top surface 29 of the spar. It is further contemplated that the ribs and spars are configured so that the top surface 32 of the ribs is contiguous with the base of the notches 28 in the spars. Each spar further includes a bottom surface 30 that forms the underside edge of the tabletop 12. As seen in comparing FIGS. 10A and 10B, the bottom surface may be arcuate, like the surface 30, or planar, like the surface 30'. Of course, other configurations for the bottom surface are contemplated. In the extrusion 26" shown in FIG. 10C, the no notch is present, so the table core may be mounted directly onto the top surface 29".

Figure 12:
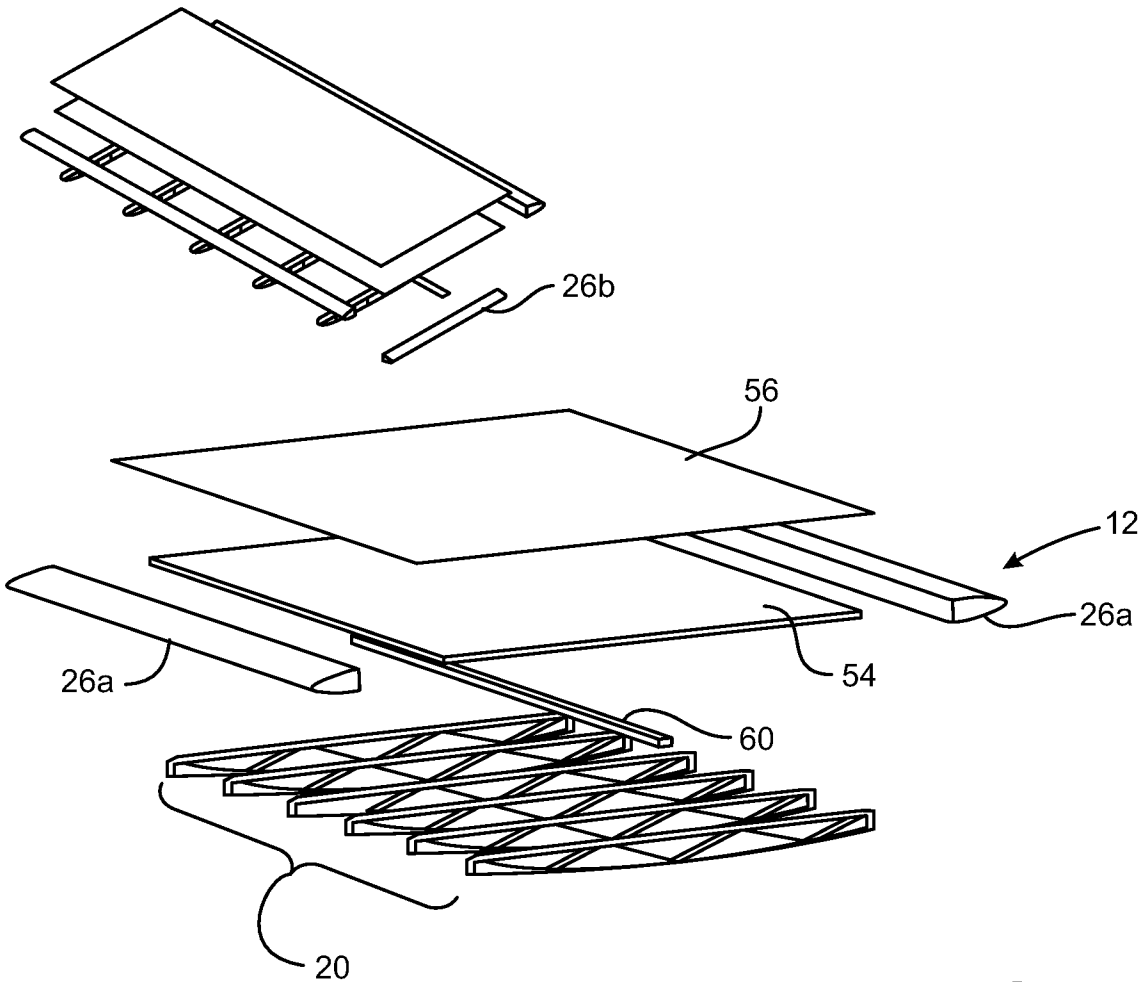
FIG. 12 is an exploded view of the components of the tabletop of FIGS. 11A-D.

The construction of one embodiment of the tabletop 12 is described with reference to FIGS. 12-14. As shown in FIG. 12, the table includes a plurality of ribs 20 engaged to spars 26*a*, 26*b* that form the frame 50 shown in FIG. 11. The table top may include a core 54 that is preferably a lightweight honeycomb structure. The core 54 is sized to seat within the notch 28 of each of the spars 26*a*, 26*b* and on the top surface 32 of the ribs 20. The core is thus fully supported at its perimeter by the spars and at its interior by the ribs. The table top may be provided with a laminate 56 that is contiguous with the core 54 or that may be sized to engage the top surface 29 of the spars. For certain tables, the connection between the tabletop and table legs may be accomplished using a mounting rod 60 extending through the ribs 20 along the length of the tabletop, as described herein.

Figure 14:
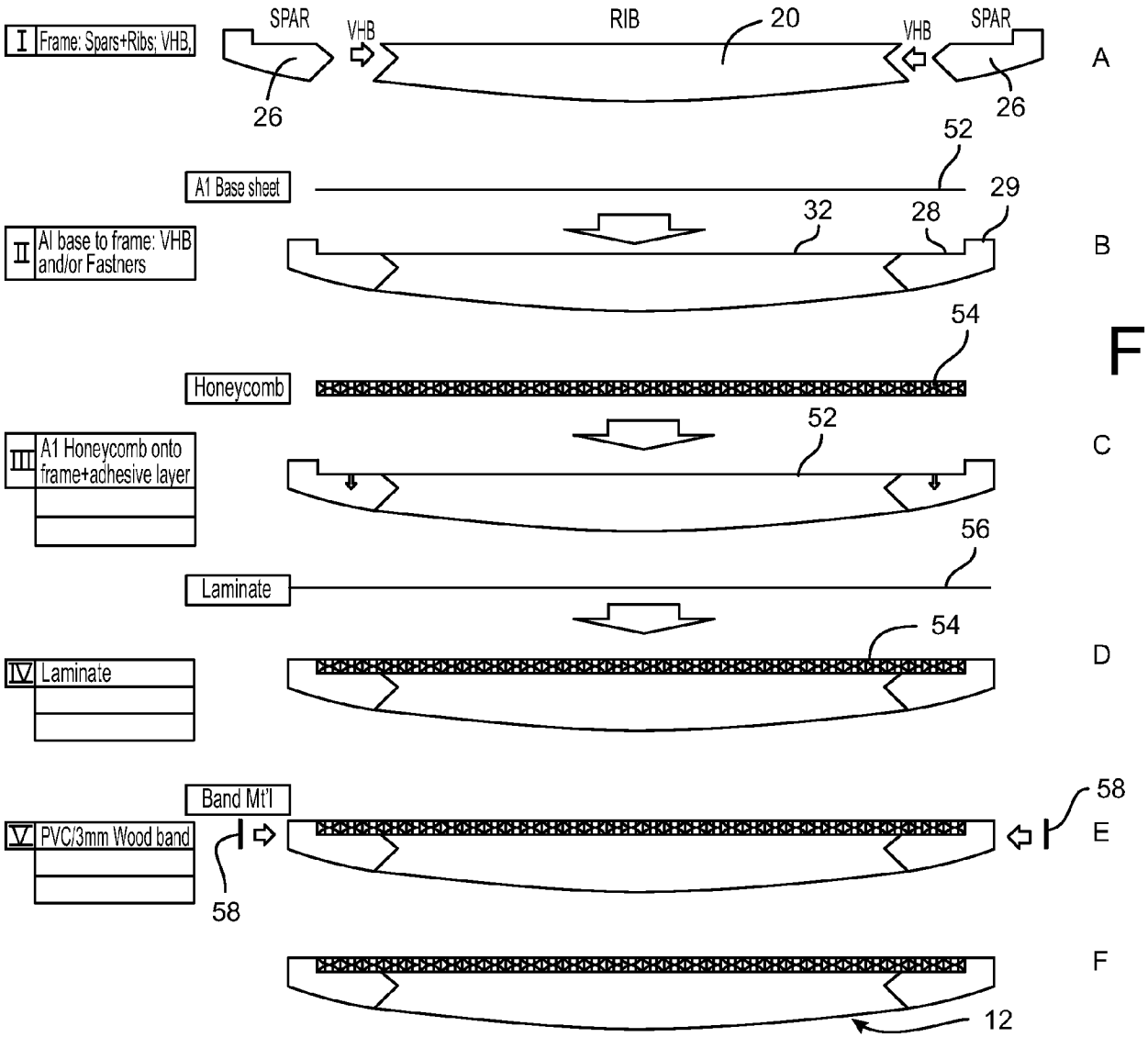
FIG. 14 is a schematic representation of the tabletop of FIGS. 11-12 in sequential stages of fabrication.

The components of the tabletop 12 may be assembled as shown in FIGS. 13-14. In particular, a fixture F may be provided as shown in Step A of FIG. 13A. The fixture may be conventionally configured so that is capable of exerting inward forces from side to side and end to end to adhere the table top components. The fixture is set at the desired dimension of the tabletop after which the ribs 20 are installed, with a mounting rod 60 as desired. The ribs may require extensions engaged within the cavities 42, or may requiring cutting down to a desired length at one of the score lines 44. In Steps C and D the spars are cut to size and introduced into the fixture F. The spar ends are mitered to form a smooth joint between the side spars 26*a* and end spars 26*b*. Once the components of the frame 50 are assembled they may be fastened together. Preferably the ribs and spars are fastened using an adhesive or glue. The fixture F may be tightened to hold the glue joints until they cure in step D. It can be appreciated that the ribs and spars are formed of a material that is capable of being glued. Thus, the ribs and spars may be formed of a lightweight resin or plastic material to be joined by compatible glue. The adhesive or glue may be cured by air-drying, or by application of heat or an infrared beam to the glued joints. Once the frame 50 has cured, the honeycomb core 54 may then be positioned within the notched 28 in the spars and on the top surface 32 of the ribs 20. As shown in Step C of FIG. 14, a base sheet 56 may be provided in which the base sheet is formed of an adherent material, such as VBS™ of 3M Company. Pressure is applied between the honeycomb core and the tabletop frame until the adhesive has set. In the next Step G in FIG. 13B, an adhesive or glue may be spread onto the top surface of the honeycomb core 54 and the spars 26 for placement of the laminate 56 in the next step. The entire tabletop assembly may be sealed in a vacuum bag operation of Step I. Once the tabletop 12 has cured the edges may be trimmed as needed and a perimeter band 58 may be added (FIG. 14, Step E) or any other desired edge finishing. Additional fixtures may be added, such as electrical boxes mounted within the tabletop 12. In the final Step K (FIG. 13B) the table legs 16 and tilt/locking mechanism 18 are added to complete the table.

In an alternative embodiment, the table top can be fabricated without the spars 26. In this embodiment, the fabrication process proceeds similar to the steps shown in FIG. 14, except that the initial step A is eliminated. Instead, the ribs 20 are supported within a fixture so that the top surface 32 of the ribs faces upward. The table top may be assembled on the ribs according to the steps B-D in FIG. 14, or may be separately fabricated and mounted on the top surface 32 of the ribs. The composite table top 52, 54, 56 is sized to extend beyond the ends of the ribs, as shown in FIG. 14, but since the spars are not present the outer perimeter of the table top is cantilevered relative to the ribs. The edge of the composite table top may be finished in a variety of ways, including providing a molded urethane edge around the perimeter. Thus, for the table 10 shown in FIG. 8, the urethane edge may correspond to the width and shape of the spars 26 that form the rectangular perimeter of the table top. The urethane edge may be applied after step D in FIG. 14, by placing the table top and ribs in a mold fixture and then introducing the urethane composition around the edge of the table top.

The composite tabletop 12 provides significant advantages over typical prior table tops. The molded construction of the ribs 20 allows for a very lightweight construction while providing high strength support for the tabletop surface. Since the ribs are lightweight, multiple ribs may be used along the length of the tabletop to ensure uniform rigidity of the tabletop along its entire length. Likewise, the spars are hollow extrusions, preferably of a lightweight resin or plastic material. Both the ribs and the spars may be provided in a standard length and then easily cut to size for smaller table dimensions. The use of a composite, resin or plastic material for the ribs (and spars in certain embodiments) allows "fastener-less" assembly, with the components readily joined by an adhesive. The honeycomb core 54 forming the horizontal surface of the table top is also very lightweight, being formed of aluminum in one embodiment. The honeycomb structure significantly reduces weight without sacrificing flexural rigidity. The honeycomb structure can be easily machined as necessary to properly size the core or to add accessories to the tabletop.

The light weight of the tabletop 12 disclosed herein makes the table extremely easy to store and deploy. As discussed more herein, the tabletop is pivotably supported on the table legs and movable from a deployed horizontal orientation to a stowed generally vertical orientation. The heavy weight of prior tables made pivoting the tabletop very difficult and cumbersome. Moreover, once the tabletop is in its stowed position, the heavy weight of prior tables made moving the table into a storage location difficult. The lightweight tabletop 12 of the present disclosure is easy to pivot and maneuver.

Figure 16:
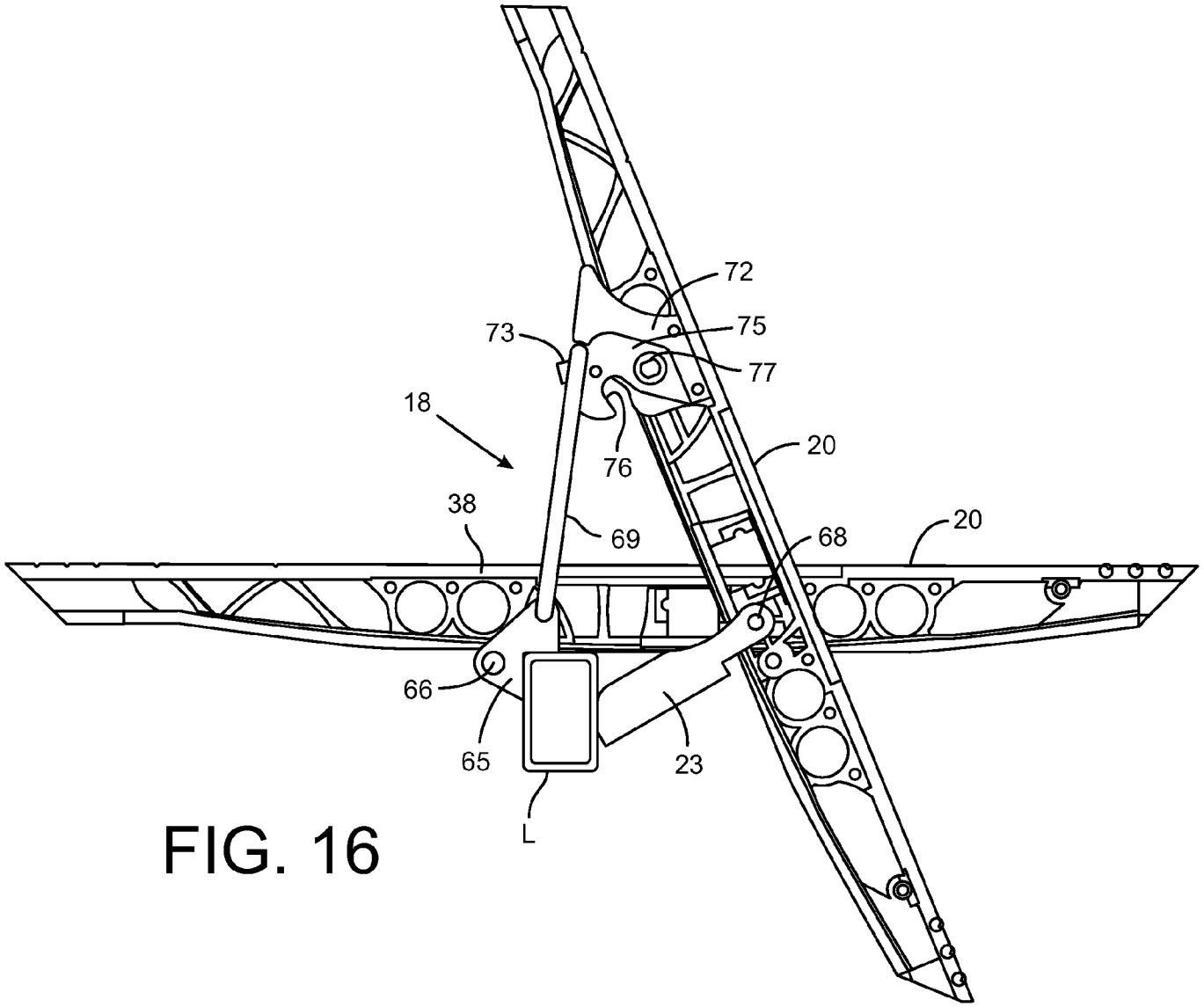
FIG. 16 is a side view of the locking mechanism of FIG. 15, depicting the two positions of the mechanism.
Figure 17:
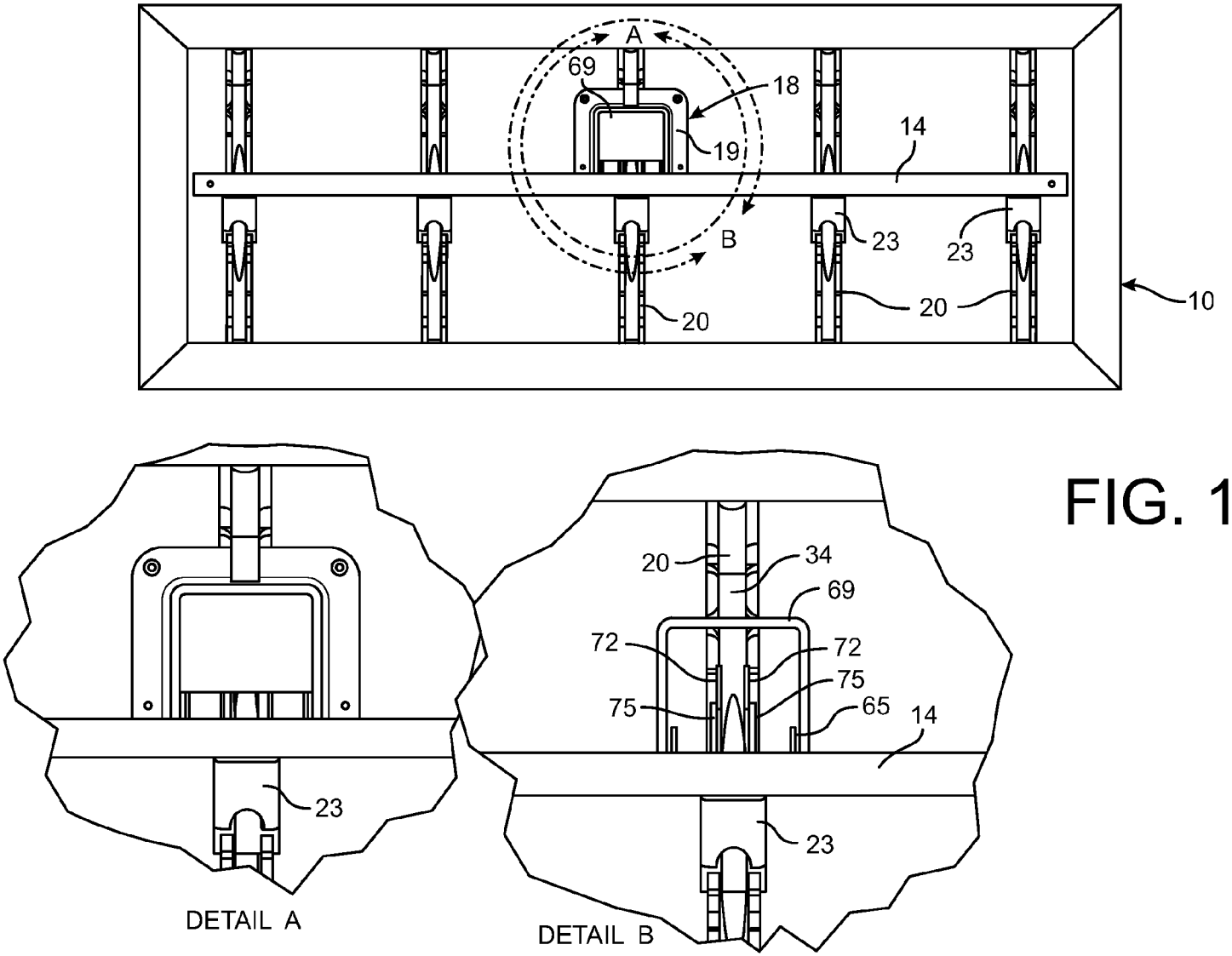
FIG. 17 is a view of the bottom of a tabletop with the locking mechanism of FIGS. 15-16 mounted thereto.

One embodiment of a pivot and locking mechanism for use with the table tops described above is shown in FIGS. 15-18. In this embodiment, the mechanism 18 is mounted to a center beam 14, as in the embodiment shown in FIGS. 1-6. The pivot link 23 described above is affixed to the center beam 14 and is pivotably connected to the ribs 20 by way of a pivot mount 68 passing through opening 40 (see FIG. 9A). The pivot mount may be a bolt/nut, rivet, or similar fastener that allows the bam 20 to pivot relative to the link 23. As shown in FIG. 17, each rib 20 may be connected to the center beam 14 by a corresponding pivot link 23. The pivot links allow the tabletop to pivot between the horizontal and generally vertical orientations shown in FIG. 16.

Figure 18:
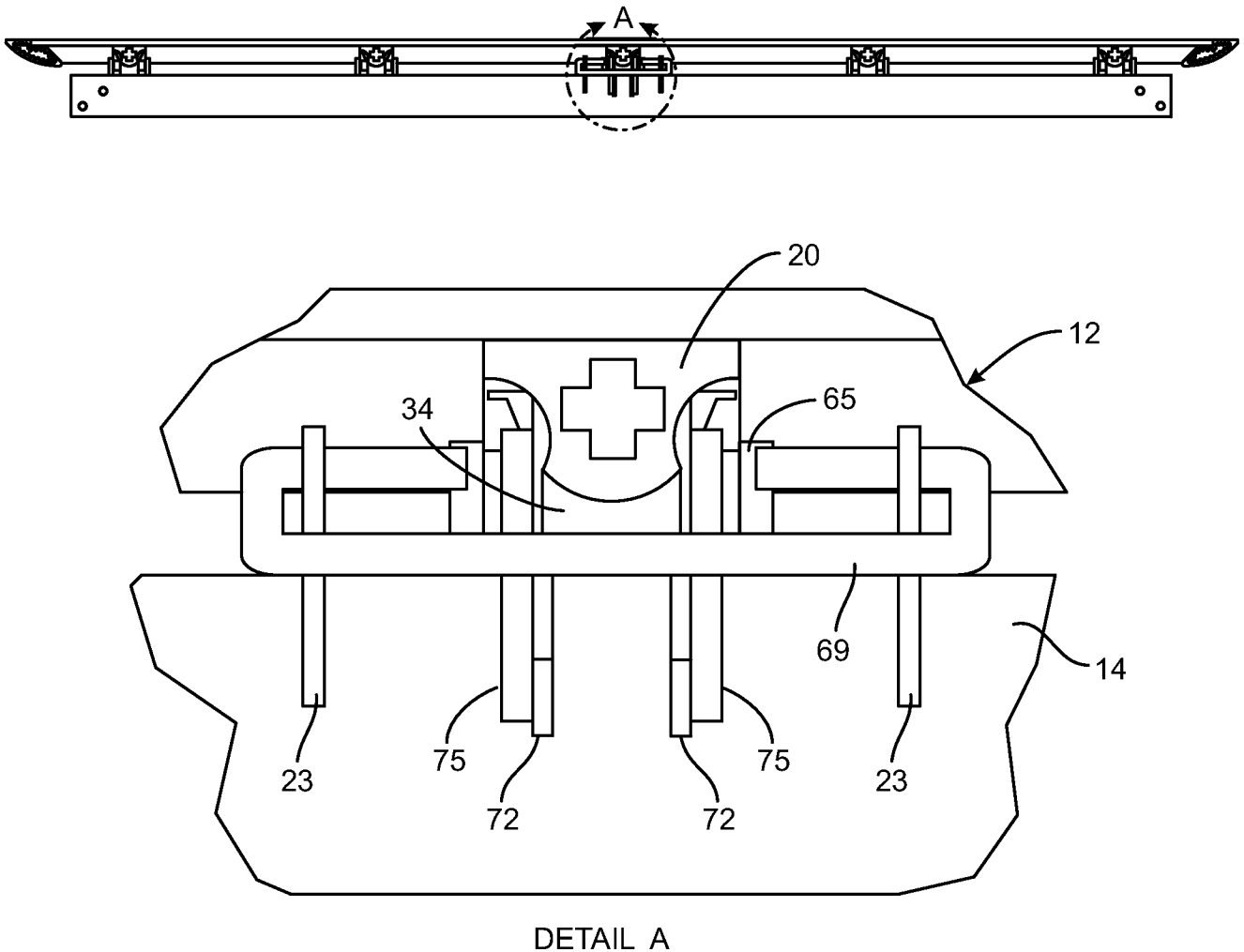
FIG. 18 is a detailed view of the locking mechanism shown in the prior figures.
Figure 19:
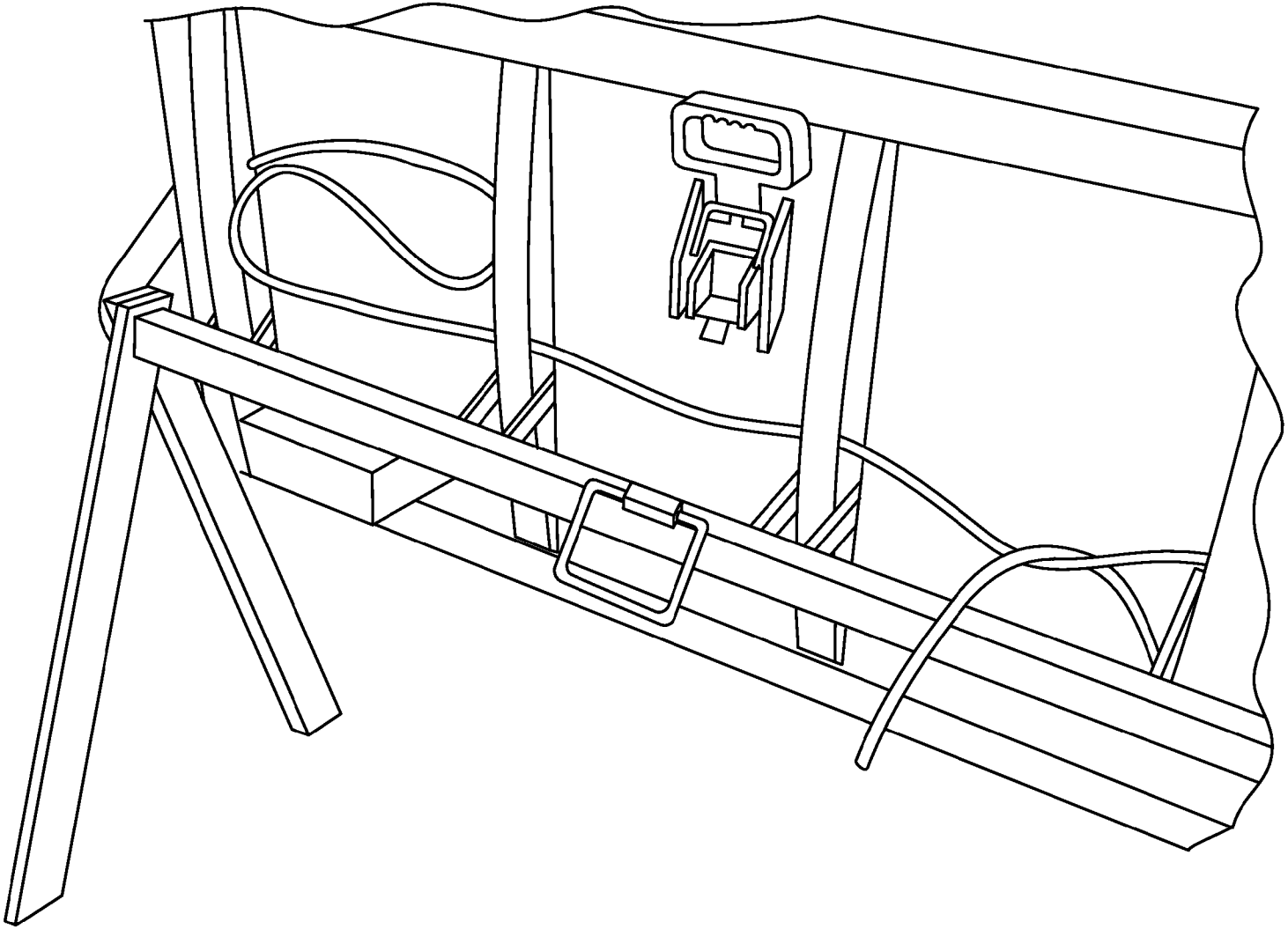
FIG. 19 is a perspective view of an alternative embodiment of a locking mechanism for the table disclosed herein.

The locking mechanism 18 further includes a pair of locking brackets 65 fastened to the center beam. The locking brackets are spaced apart on the center beam to straddle the ribs 20, as best seen in FIG. 18. A locking bar 66 (FIGS. 15-16) extends between the pair of locking brackets, essentially beneath the bottom surface 34 of the rib 20. A U-shaped engagement bar 69 is pivotably supported by the two locking brackets 65 and is preferably spring-biased to the position shown in FIGS. 15-16. (It is understood that the tabletop itself will prevent the engagement bar from moving to the vertical position shown since the bar will contact the bottom of the rib 20).

Figure 15:
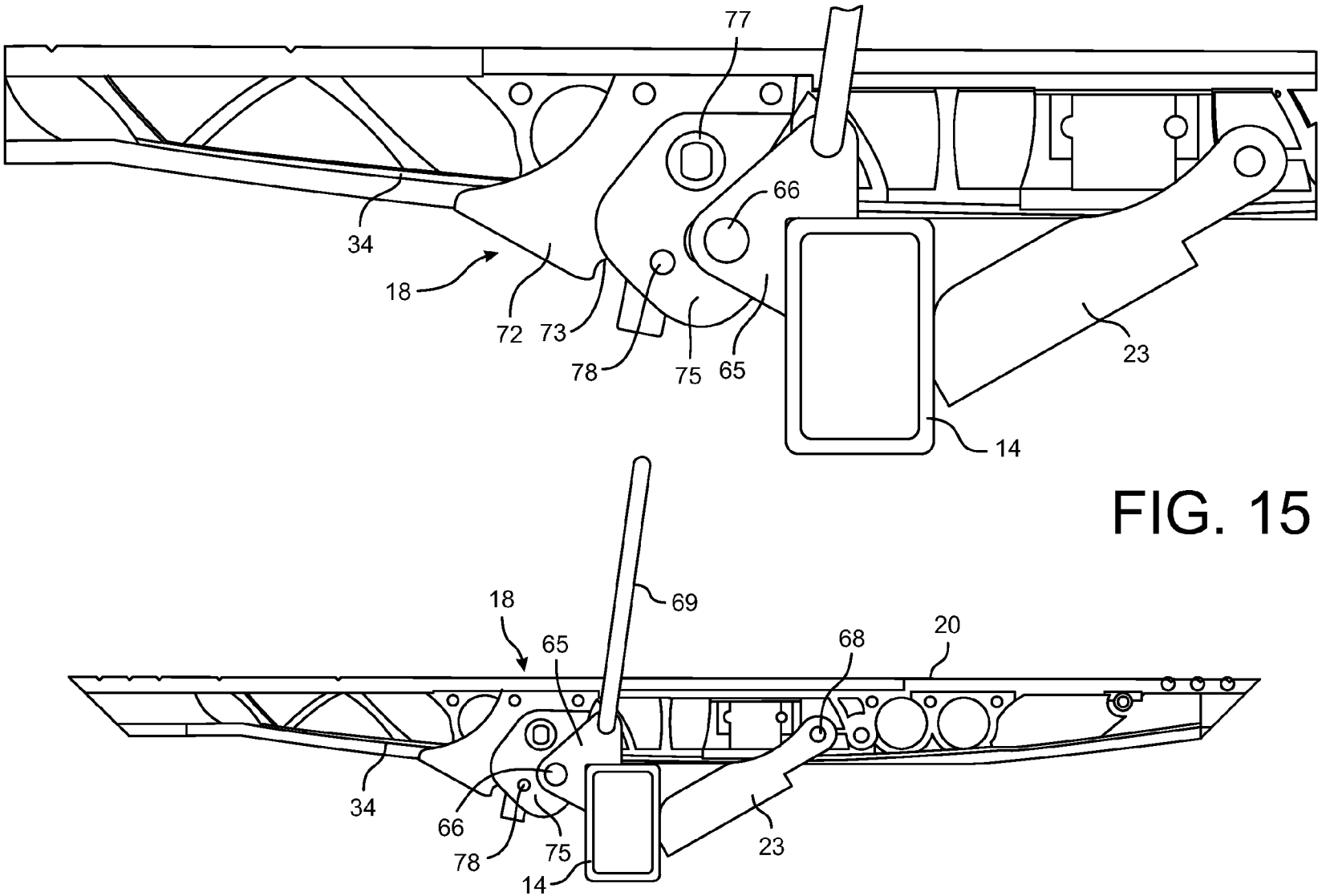
FIG. 15 is a side view of a locking mechanism for use with the table shown in FIG. 1.

The center-most transverse support rib 20 can carry other components of the locking mechanism. A mounting flange 72 is fastened to the rib 20 at one of mounting arrays 38 (FIG. 9A). The bracket defines an engagement notch 73 that receives the engagement bar 69, as shown in FIG. 16. The locking bracket 72 pivotably supports a pair of locking plates 75 at a pivot mount 77. The pivot mount may be spring biased to bias the engagement notch 76 (FIG. 16) into engagement with the locking bar 66 in the position shown in FIG. 15. A release lever is fastened to the locking bracket 65 at the pin location 78. The release lever (not shown) may be a U-shaped lever spanning between the pin locations 78 on the two locking brackets 65 mounted to either side of the ribs. When the tabletop is in its deployed and locked position, as depicted in FIG. 15, pulling the release lever pivots the locking plate 75 away from the locking bar 66 to thereby disengage the locking mechanism and permit pivoting of the tabletop 12 relative to the legs. The locking mechanism 18 just described may be similar to the mechanism disclosed in pending application published as No. US2010/0307383 A1, entitled "Tilting Tabletop Mechanism." The release lever may thus be constructed like the lever arrangement 196, 200 in that application. The tilting and locking mechanism disclosed in that pending application is mounted directly to the underside of the tabletop and is not integrated into a transverse rib, as in the embodiment of FIG. 15, although the working components are similar to those just described. It can be appreciated, however, that the ribs 20 disclosed herein can streamline and simplify the tilting and locking mechanism construction from a tabletop mounted mechanism. In addition, the overall weight of the mechanism 18 can be significantly reduced because a mounting plate is not required to mount the mechanism to the tabletop. For instance, a typical 24 in.×60 in. table top weighs about 60 lbs, but a table top produced according to the present disclosure weighs only about 20 lbs.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A table comprising:

a composite table top including a honeycomb core and a laminate layer on a top surface of said core;

a plurality of ribs arranged substantially parallel to each other along a length or width dimension of said core, said ribs including a top plate affixed to said core, a bottom beam opposite said top plate, and a web structure connecting said top plate to said bottom beam, said web structure defining a plurality of openings therethrough;

a leg assembly including a center beam extending parallel to said length or said width dimension of said core perpendicular to said plurality of ribs and support legs engaged to the opposite ends of said center beam and configured to support the table top; and at least two pivot mechanisms, each pivot mechanism connected between said center beam and said composite table top.

2. The table of claim 1, wherein each of said at least two pivot mechanisms is connected to said table top through at least two of said number of openings of a corresponding one of said plurality of ribs.

3. The table of claim 1, further comprising a locking mechanism connected between said center beam of said leg assembly and said table top, said locking mechanism configured to lock said table top in a horizontal deployed position and a generally vertical stowed position.

4. The table of claim 3, wherein:

said plurality of ribs includes a center rib disposed in the center of the length or width dimension of the table top; and said locking mechanism includes:

a pivot link fastened at one end to said center beam and pivotably engaged at an opposite end to one of said plurality of openings in said web structure of the center rib;

a latch mechanism mounted to said web structure at another one of said plurality of openings; and an engagement bar pivotably mounted at one end to said center beam and configured at an opposite end to engage said latch mechanism when said table top is pivoted upward relative to said center beam.

5. The table of claim 4, wherein said pivot link, said latch mechanism and said engagement bar straddle said center rib.

6. The table of claim 1, wherein said composite table top includes a base plate affixed between said honeycomb core and said top plate of said plurality of ribs.

7. The table of claim 1, wherein each of said plurality of ribs includes a number of score lines adjacent each opposite end thereof, said score lines adapted to sever the end of the rib to shorten the length of the rib.

8. The table of claim 1, wherein:

each of said plurality of ribs includes a cavity defined in at least one of the opposite ends thereof; and the table includes an extension having a post for engaging said cavity so that said extension extends outward from a corresponding rib to extend the length of the rib, said extension defining a top surface that is co-extensive with the top surface of said corresponding rib when the extension is engaged thereto.

9. The table of claim 1, wherein said composite table top includes a molded edge molded around the perimeter of the table top.

10. The table of claim 9, wherein the molded edge is formed of a urethane.

11. The table of claim 1, wherein said honeycomb core is formed of aluminum.

12. The table of claim 11, wherein said base plate is formed of aluminum.

13. The table of claim 1 wherein said plurality of ribs includes a rib adjacent each end of the table top.

14. The table of claim 1, wherein said at least two pivot mechanisms includes a pivot mechanism connected between said center beam and each of said plurality of ribs.

* * * * *